United States Patent [19]

Johnson

[11] 4,017,083

[45] Apr. 12, 1977

[54] PUTTER

[76] Inventor: James A. Johnson, 59 Ocean House Road, Cape Elizabeth, Maine 04107

[22] Filed: Sept. 19, 1975

[21] Appl. No.: 615,095

[52] U.S. Cl. ..... 273/164; 273/186 A; 273/193 R; 273/167 C; 273/167 B; 273/169; 46/50; 273/171

[51] Int. Cl.[2] ..... A63B 69/36; A63H 1/32

[58] Field of Search ..... 273/162 R, 193 R, 186 A, 273/163, 164, 183 D, 167 C, 167 B, 169; 46/50

[56] References Cited

UNITED STATES PATENTS

| | | | |
|---|---|---|---|
| 1,876,657 | 9/1932 | Fox | 273/193 R X |
| 2,823,037 | 2/1958 | Ferte | 273/162 R X |
| 2,910,297 | 10/1959 | Bonetate | 273/162 R X |
| 3,019,555 | 2/1962 | Poticha | 46/50 X |
| 3,700,239 | 10/1972 | Paterick et al. | 46/50 X |
| 3,700,244 | 10/1972 | Liotta | 273/162 R |

*Primary Examiner*—George J. Marlo

[57] ABSTRACT

A putter has a chamber extending lengthwise of its head in which there is a battery powered motor driving a fly wheel at the outer end of the head at a rate such that a gyroscopic force is provided adequate to stabilize the head against being turned by the golfer as a putt is made. The head is shown as symmetrical so that a putter may be used by either a left-handed or a right-handed golfer and the head may be weighted as desired by placing one or more weights within the chamber. The switch control of the circuit may be manually operated or of the mercury type.

9 Claims, 3 Drawing Figures

PUTTER

BACKGROUND REFERENCES

U.S. Letters Pat. No. 3,677,553
U.S. Letters Pat. No. 3,394,937
U.S. Letters Pat. No. 3,387,844
U.S. Letters Pat. No. 3,333,854
U.S. Letters Pat. No. 3,270,564
U.S. Letters Pat. No. 3,182,508
U.S. Letters Pat. No. 2,432,450
U.S. Design Letters Pat. No. 156,963
Australian Letters Pat. No. 153,475
British Letters Pat. No. 14,169

BACKGROUND OF THE INVENTION

While success in golf requires that the use of all golf clubs be mastered, the use of a putter is peculiar in that it requires that the ball be tapped with the point on the head that is to engage the ball to be moved along a line representing the wanted path of the ball to the cup. While the determining of such a path and the positioning of the head at right angles thereto are, of course, essential, it is equally important to avoid a cause of putting error, the imperceptible turning of the shaft of the putter as the head of the putter approaches or comes into contact with the ball and the consequential minute change in the angle of the head relative to the wanted path of the ball.

The Present Invention

The general objective of the present invention is to provide a putter that will minimize putting errors due to the cause above referred-to, an objective attained by providing a putter, the head of which has a chamber housing a battery powered motor and a fly wheel driven thereby with the fly wheel axis included in the longitudinal center line of the head and the fly wheel rotating at a speed providing gyroscopic stabilizing force to the putter adjacent the outer end of its head.

Another objective of the invention is to provide a putter head that is of a cross sectional shape to ensure that an overspin is imparted to a putt ball and desirably symmetrical so that the putter may be used by either left or right handed golfers.

Yet another objective of the invention is to provide a putter than can be modified, as far as its weight is concerned, to meet the individual requirements of its user, an objective attained by dimensioning the chamber to ensure room for one or more weights.

Brief Description of the Drawings

Preferred embodiments of the invention are illustrated by the accompanying drawings with FIG. 1 a side elevation of a putter in accordance with the invention.

The Preferred Embodiments of the Invention

Figure 1:
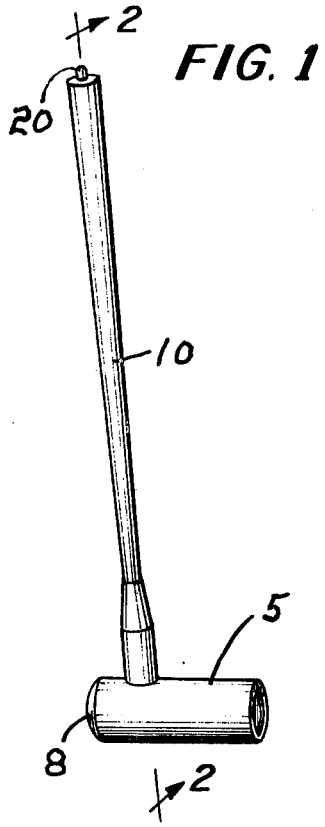
Figure 2:
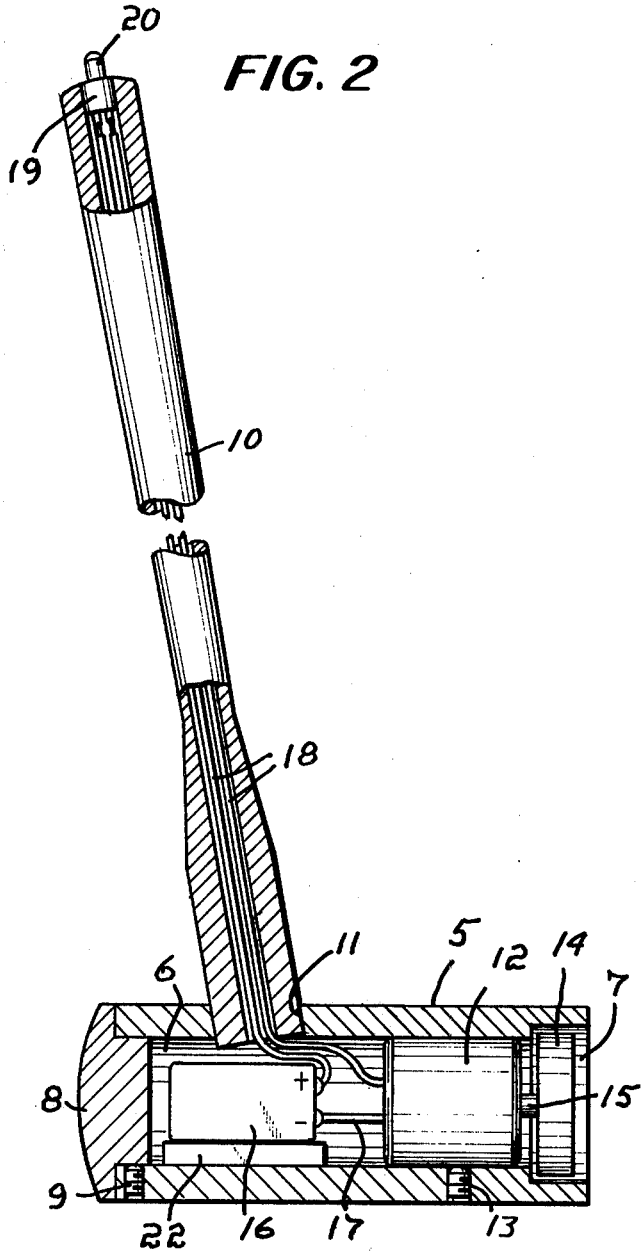
FIG. 2 is a like and partly sectioned view thereof on an increase in scale.

The putter illustrated in the drawings has a head 5 having a chamber 6 extending from end-to-end thereof along its center line with a short counter bore 7 at its outer end and a cover 8 removably secured in its rear end as by a set screw 9.

The shaft 10 of the putter is tubular and is a press fit in a bore 11 opening into the chamber 6 through the head 5 and inclined rearwardly at an angle of approximately 10° relative to a center line that is perpendicular to the longitudinal center line of the head 5.

A high speed, low voltage motor 12 is detachably secured in the chamber 6 as by a set screw 13 and has a fly wheel 14 fixed on its drive shaft 15, the fly wheel 14 fitting within the counter bore 7. A battery pack 16 within the chamber 6 has a lead 17 connected directly to the motor 12 with its other lead 18 extending to and from a manually operated switch 19 fixed in the upper end of the shaft 10 with its actuator 20 exposed.

Figure 3:
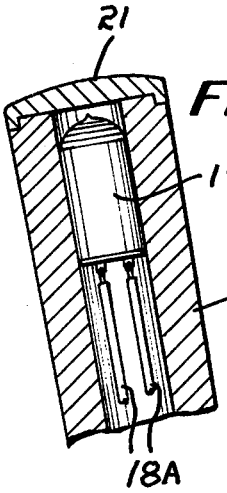
FIG. 3 is a fragmentary section taken lengthwise of the upper end of the shaft with a mercury switch replacing the manually operated switch shown in FIGS. 1 and 2.

Before describing the operation of putters in accordance with the invention, reference is made to FIG. 3 wherein there is shown the upper end of a tubular putter shaft 10A with a mercury switch 19A in the lead 18A. The upper end of the tubular shaft 10A is shown as closed by a removable cap 21.

In operation, when a putt is to be made, the circuit is closed to energize the motor 12 which effects the rotation of the fly wheel at a rate, 8,000 R.P.M., for example, adequate to provide a gyroscopic stabilizing force at the outer end of the head 5 which, as the putt is made, minimizes the possibility of the head 5 turning from a position in which the axis of the fly wheel 14 is at the necessary 90° relationship with the selected pathway for the ball.

While the manually operated switch, such as the switch 19 has certain advantages, the use of a mercury type of switch, such as the switch 19A, is preferred as whenever the putter is held for use, the circuit to the motor is closed and whenever the putter is in the golf bag, the circuit is open.

The chamber 6 affords the additional advantage that a weight or weights 22 may be stored in the rear end thereof if the user so desires.

It is preferred that the head 5 be symmetrical and desirably cylindrical in cross section so that not only does it ensure that an overspin is imparted to a ball but also that the putter can be used equally effectively by either a left or right handed golfer.

I claim:

1. A putter comprising a shaft and a head including a ball engaging portion having a chamber, a fly wheel within said chamber adjacent the outer end of said head with its axis disposed lengthwise thereof, the length of said shaft and the angle between said shaft and said axis being such as to enable the ball to be engaged by the ball engaging portion of the head when the shaft is held by the user while standing in putting position, and a battery powered drive for said fly wheel within said putter and connected to said fly wheel, said drive operable to effect the rotation of said fly wheel at a rate such that a gyroscopic force is exerted on the outer end of the head adequate to stabilize the head against accidental turning during a putt from a position at right angles to the wanted path for the ball, said drive including a battery source, a low voltage, high speed motor, and a circuit between said motor and said source and including a switch.

2. The putter of claim 1 in which the switch is a mercury switch and is positioned to maintain the circuit open except when the putter is held in a putting position.

3. The putter of claim 1 in which the shaft is tubular, the battery source and the motor are also within the chamber and one lead of the circuit extends within the shaft to the free end thereof, and the switch is adjacent said end.

4. The putter of claim 3 in which the switch is of a manually operated type and includes an actuator exposed externally of said shaft end.

5. The putter of claim 3 in which the switch is a mercury switch positioned to be open except when the putter is held in a putting position.

6. The putter of claim 3 in which the chamber extends from end-to-end of the head, detachable means closing the rear end thereof, and the chamber is dimensioned to receive weights.

7. The putter of claim 3 in which the head is symmetrical in lengthwise cross section, the chamber extends centrally from end-to-end thereof, and the diameter of the head is such that in making a putt, an overspin is imparted to the ball.

8. The putter of claim 7 in which the head is cylindrical in lengthwise cross section and the chamber is concentric.

9. The putter of claim 1 in which the chamber has a counter bore in its outer end dimensioned to receive the fly wheel and means detachably closing the other end of said chamber.

* * * * *